US006729906B1

(12) United States Patent
Simmons et al.

(10) Patent No.: US 6,729,906 B1
(45) Date of Patent: May 4, 2004

(54) SIGNAL CONDITIONED MODULAR JACK ASSEMBLY WITH IMPROVED SHIELDING

(75) Inventors: Randy G. Simmons, Winston Salem, NC (US); Victor E. Slack, Lewisville, NC (US); Eric C. Laurer, Clemmons, NC (US); Kevin J. Peterson, High Point, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/418,460

(22) Filed: Apr. 18, 2003

Related U.S. Application Data

(60) Provisional application No. 60/439,755, filed on Jan. 13, 2003.

(51) Int. Cl.[7] ..... H01R 13/548

(52) U.S. Cl. ..... 439/607; 439/541.5; 439/490

(58) Field of Search ..... 439/607, 676, 439/541.5, 903, 941, 490, 404, 620, 701, 79–80, 70, 717, 752

(56) References Cited

U.S. PATENT DOCUMENTS

| | | | | |
|---|---|---|---|---|
| 4,978,317 A | | 12/1990 | Pocrass | 439/490 |
| 5,531,612 A | | 7/1996 | Goodall et al. | 439/541.5 |
| 5,876,240 A | | 3/1999 | Derstine et al. | 439/490 |
| 5,924,890 A | | 7/1999 | Morin et al. | 439/490 |
| 6,120,318 A | | 9/2000 | Reed et al. | 439/490 |
| 6,162,089 A | * | 12/2000 | Costello et al. | 439/541.5 |
| 6,206,725 B1 | * | 3/2001 | Wu | 439/541.5 |
| 6,227,911 B1 | | 5/2001 | Boutros et al. | 439/620 |
| 6,511,348 B1 | * | 1/2003 | Wojtacki et al. | 439/620 |
| 6,572,411 B1 | * | 6/2003 | Aeschbacher et al. | 439/620 |
| 6,586,540 B1 | * | 7/2003 | De Lange et al. | 526/74 |
| 6,655,988 B1 | * | 12/2003 | Simmons et al. | 439/541.5 |

* cited by examiner

*Primary Examiner*—Gary V. Pauman
*Assistant Examiner*—Phuongchi Nguyen

(57) ABSTRACT

A stack jack modular jack assembly is comprised of a multi-port housing, and a plurality of modular jack subassemblies. The jack subassemblies include upper and lower jack housing sandwiching therebetween, a cross-talk shield. The terminal subassembly is substantially Z-shaped, which allows for increased space there below for signal conditioning components. The terminal module also includes a center shield and a lower shield, and an outer shield, all of which are commoned together and grounded. An outer shield substantially surrounds the entire assembly, and is commoned to the other shield members.

33 Claims, 18 Drawing Sheets

SIGNAL CONDITIONED MODULAR JACK ASSEMBLY WITH IMPROVED SHIELDING

This application claims the benefit of U.S. Provisional Patent Application Ser. No. 60/439,755 filed Jan. 13, 2003, the complete disclosure of which is hereby expressly incorporated by reference.

BACKGROUND OF THE INVENTION

The invention relates to a connection assembly providing multiple port connections.

Known connector assemblies exist having multiple receptacle connectors in a common housing, which provide a compact arrangement of such receptacle connectors. Such a connector assembly is useful to provide multiple connection ports. Accordingly, such a connector assembly is referred to as a multiple port connector assembly. In preferred arrays, the housing has jacks one above the other, forming a plurality of arrays in stacked arrangement, so-called "stacked jack" arrangements. The receptacle connectors, that is, modular jacks, each have electrical terminals arranged in a terminal array, and have plug receiving cavities. Specifically, the receptacle connectors are in the form of RJ-45 type modular jacks that establish mating connections with corresponding RJ-45 modular plugs.

For example, as disclosed in U.S. Pat. No. 5,531,612, a connector assembly has two rows of receptacle connectors, that is, modular jacks, arranged side-by-side in an upper row and side-by-side in a lower row in a common housing, which advantageously doubles the number of receptacle connectors without having to increase the length of the housing. The receptacle connectors have plug receiving sections with plug receiving cavities that are profiled to surround modular plugs that are to be inserted in the cavities. The modular plugs have resilient latches, which engage with latching sections on the modular jacks. The latches are capable of being grasped by hand, and being resiliently bent inwardly toward the plugs to release them from engagement with the latching sections on the modular jacks.

One application for such connector assemblies is in the field of telephony, wherein the modular jacks provide ports for connection with a telephone switching network of a telephone service provider, such as a regional telephone company or national telephone company. The corresponding RJ-45 modular plugs terminate opposite ends of telephone cords leading to wall-mounted telephone outlets inside a building. The telephone outlets connect to telephone lines outside of the building, which, in turn, connect to the telephone switching network of the telephone service provider.

Alternatively, such connection systems have found utility in office computer networks, where desktops are interconnected to office servers by way of sophisticated cabling. Such networks have a variety of data transmission mediums including coaxial cable, fiber optic cable and telephone cable. One such network topography is known as the Ethernet network, which is subject to various electrical standards, such as IEEE 802.3 and others. Such networks have the requirement to provide a high number of distributed connections, yet optimally requires little space in which to accommodate the connections.

Furthermore, such networks now operate at speeds of 1 gigabit and higher which requires significant conditioning to the signals. For instance, it is common to require shielding for controlling electromagnetic radiation per FCC standards, while at the same time controlling electromagnetic interference (EMI) within the assembly, between adjacent connections. It is therefore also a requirement to provide such components within the assembly as magnetic coils, inductors, chip capacitors, and the like, to condition the signals. While the technology exists for conditioning the signals, no connection devices exist which are capable of handling such speeds, while at the same time package the signal conditioning components required to maintain these speeds.

Another design is shown in U.S. Pat. No. 6,227,911 to Boutros et al., which discloses a modular jack assembly having multiple ports for connection to multiple modular jacks. While this assembly further discloses having packaged magnetic assemblies, or other components, this design, as in other attempts to signal condition connection devices, simply adds the components to known connection devices. Therefore, the volume within the assembly is inadequate to provide the proper signal conditioning devices for the high speeds now required.

Furthermore, in order to ensure that a proper connection has been made and therefore a link is created between the electrical communication devices, indicators are often incorporated into circuits on the printed circuit board. These indicators are typically light emitting diodes (LEDs) which are turned on when a circuit is completed between the mating connectors and the communication devices. Additionally LEDs can be mounted on the printed circuit board to indicate a number of other conditions including the passage of communication signals between the two communication devices, indication of power, or indication that an error in transmitting the signals has occurred.

In an effort to miniaturize printed circuit boards and save board real estate, LED indicators have been integrated into these connectors. An example of such a connector is disclosed in U.S. Pat. No. 4,978,317 to Pocrass which teaches a connector for receiving a plug having a visual indicator positioned within the front wall of the electrical connector housing. Incorporation of the indicator into the electrical connector eliminates the need for a separate location on the printed circuit board for mounting of such an indicator. The LED indicator is inserted into a recess of the electrical connector such that its electrical leads pass through the recess and connect to the printed circuit board. The indicator is then cemented into the recess or attached using an appropriate adhesive. The LEDs may also be molded into the electrical connector during the molding process of the housing. However, this device of Pocrass is shown for only a single cavity housing, and it is not readily ascertainable how it might be reconfigured for a multi-port or a stacked jack configuration.

The objects of the inventions are therefore to overcome the shortcomings of the prior art.

The objects have been accomplished by providing an electrical connector assembly having a plurality of rows of jacks for mating with a plurality of electrical plugs. The connector assembly comprises plural lead frames, the lead frames including front mating contact sections, and conductor contacting sections. A center shield is positioned between the lead frames, and a transverse shield is positioned transversely to the center shield. A lower shield is positioned below the transverse shield, wherein the center shield, transverse shield and lower shield are commoned together. A first array of passive components are positioned on one side of the transverse shield, between the center shield and the lower shield. A second array of passive components are positioned on the opposite side of the transverse shield as the first array, between the center shield and the lower shield. An insulating module housing at least partially surrounds the pluggable contact module, the center shield, the transverse shield, the lower shield, and the first and second array of passive components, thereby defining a pluggable contact module. An insulating outer housing has a mating face having at least two connector receiving openings for receiving mating connectors therein, and module receiving openings for receipt of the pluggable contact modules.

At least one of the shields comprises a shielding contact extension, and the insulating module housing comprises an opening with the shielding contact extension, extending therethrough. An outer shielding member substantially surrounds the insulating outer housing and the pluggable contact modules. The outer shielding member includes an opening therethrough for receiving the shielding contact extension in an electrically engaging manner. The lead frames include intermediate sections and printed circuit board contact sections, the lead frames being profiled in a substantial Z-shape with the front mating contact sections of the plural lead frames being positioned adjacent to a central plane, with the printed circuit board contact sections from the plural lead frames being positioned proximate each other but remotely from the central plane, thereby defining a volume for the passive devices, the pluggable contact module further comprising at least one printed circuit board carrying passive devices positioned thereon, the printed circuit board being attached to the printed circuit board contact sections, with the passive devices occupying the volume.

The pluggable contact module is comprised of two lead frames. The lead frame intermediate contact sections include forward sections lying in a substantially horizontal plane, with the front mating contact sections being reversely bent from the forward sections. The lead frame intermediate contact sections further comprise perpendicular sections extending from the forward sections. The lead frame intermediate contact sections further comprise rearward sections extending from the perpendicular sections, the rearward sections lying in a substantially horizontal plane.

The intermediate contact sections are at least partially overmolded with insulative material. The lead frames and the intermediate center shield are closely conforming to each other to form a lamination. The rearward sections are each overmolded with an insulative material, to define a side board mounting edge, with the printed circuit contacts extending therefrom. The printed circuit board contacts for each lead frame extend from opposite side edges. Two printed circuit boards are mounted to the side board mounting edges. The lower shield, transverse center shield and the intermediate shield are all electrically commoned together.

An insulative housing shell is positioned around printed circuit board and shields. The insulating housing has a top wall, a bottom wall, an intermediate wall forming an upper and lower row, and a plurality of modular openings formed in the upper and lower row, and the insulative shells are pluggable in the modular openings to form a stacked jack assembly.

In another aspect of the invention, an electrical connector assembly has a plurality of rows of jacks for mating with a plurality of electrical plugs. The connector assembly comprises plural lead frames, the lead frames including front mating contact sections, and conductor contacting sections. A center shield is positioned between the lead frames, and a transverse shield is positioned transversely to said center shield. A first array of passive components are positioned on one side of the transverse shield, between the center shield and the lower shield. A second array of passive components are positioned on the opposite side of the transverse shield as the first array, between the center shield and the lower shield. An insulating module housing at least partially surrounds the pluggable contact module, the center shield, the transverse shield, the lower shield, and the first and second array of passive components, thereby defining a plurality of pluggable contact modules. An insulating outer housing has a mating face having at least two connector receiving openings for receiving mating connectors therein, and module receiving openings for receipt of the pluggable contact modules. An outer shielding member substantially surrounds the insulating outer housing and the pluggable contact modules.

A lower shield is positioned below the transverse shield, wherein the center shield, transverse shield and lower shield are commoned together. At least one of the shields comprises a shielding contact extension, and the insulating module housing comprises an opening with the shielding contact extension, extending therethrough. The outer shielding member includes an opening therethrough for receiving the shielding contact extension in an electrically engaging manner. The lead frames and center shield member are Z-shaped in configuration. The lead frame intermediate contact sections include forward sections lying in a substantially horizontal plane, with the front mating contact sections being reversely bent from the forward sections. The lead frame intermediate contact sections further comprise perpendicular sections extending from the forward sections. The lead frame intermediate contact sections further comprise rearward sections extending from the perpendicular sections, the rearward sections lying in a substantially horizontal plane.

The intermediate contact sections are at least partially overmolded with insulative material. The lead frames and the intermediate center shield are closely conforming to each other to form a lamination. The rearward sections are each overmolded with an insulative material, to define a side board mounting edge, with the printed circuit contacts extending therefrom. The printed circuit board contacts for each lead frame extend from opposite side edges. Two printed circuit boards are mounted to the side board mounting edges. The lower shield is positioned below the printed circuit boards. The lower shield, transverse center shield and the intermediate shield are all electrically commoned together.

DETAILED DESCRIPTION OF THE INVENTION

Figure 1:
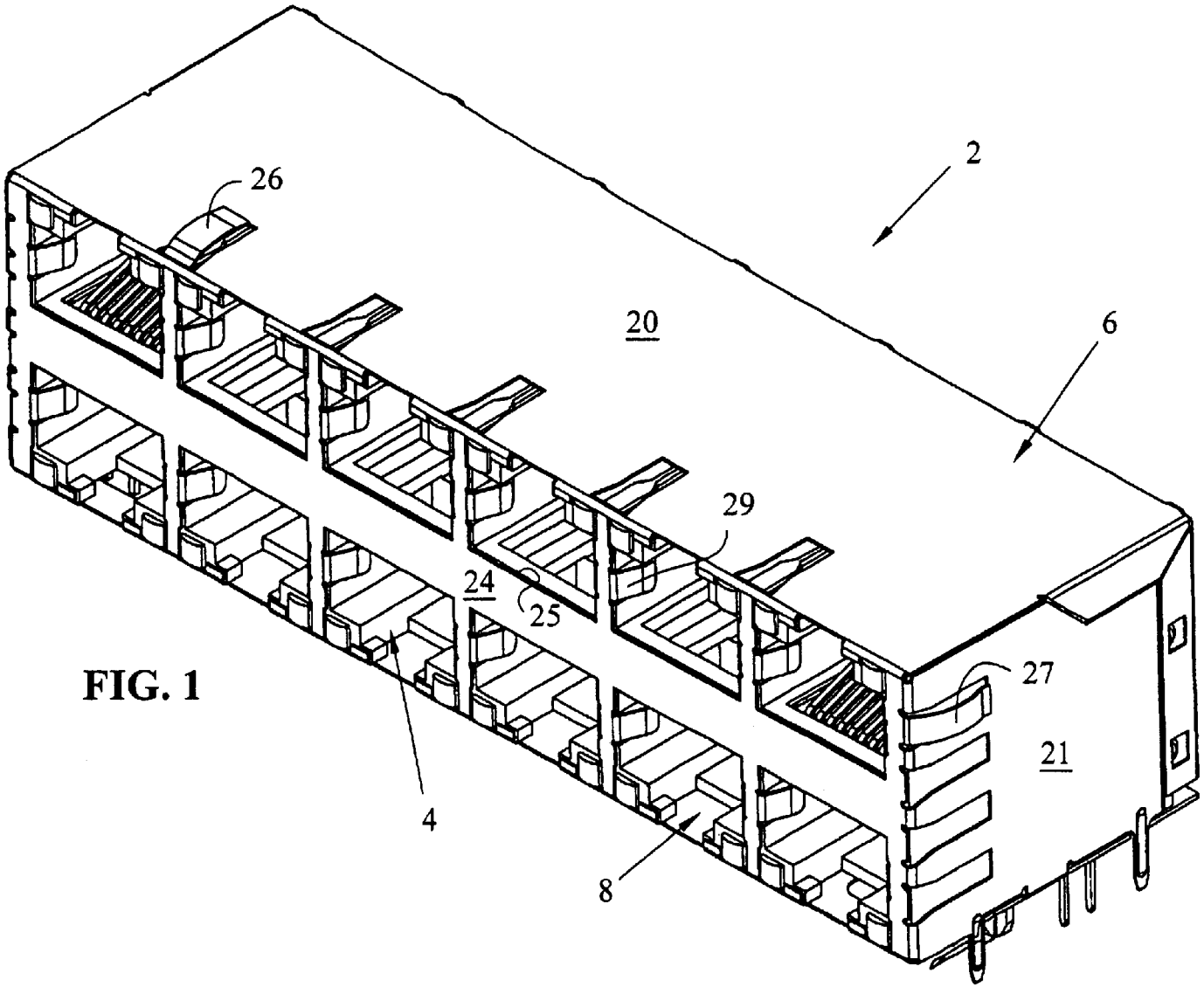
FIG. 1 is a perspective view showing the multiple port jack assembly from the front side thereof.
Figure 2:
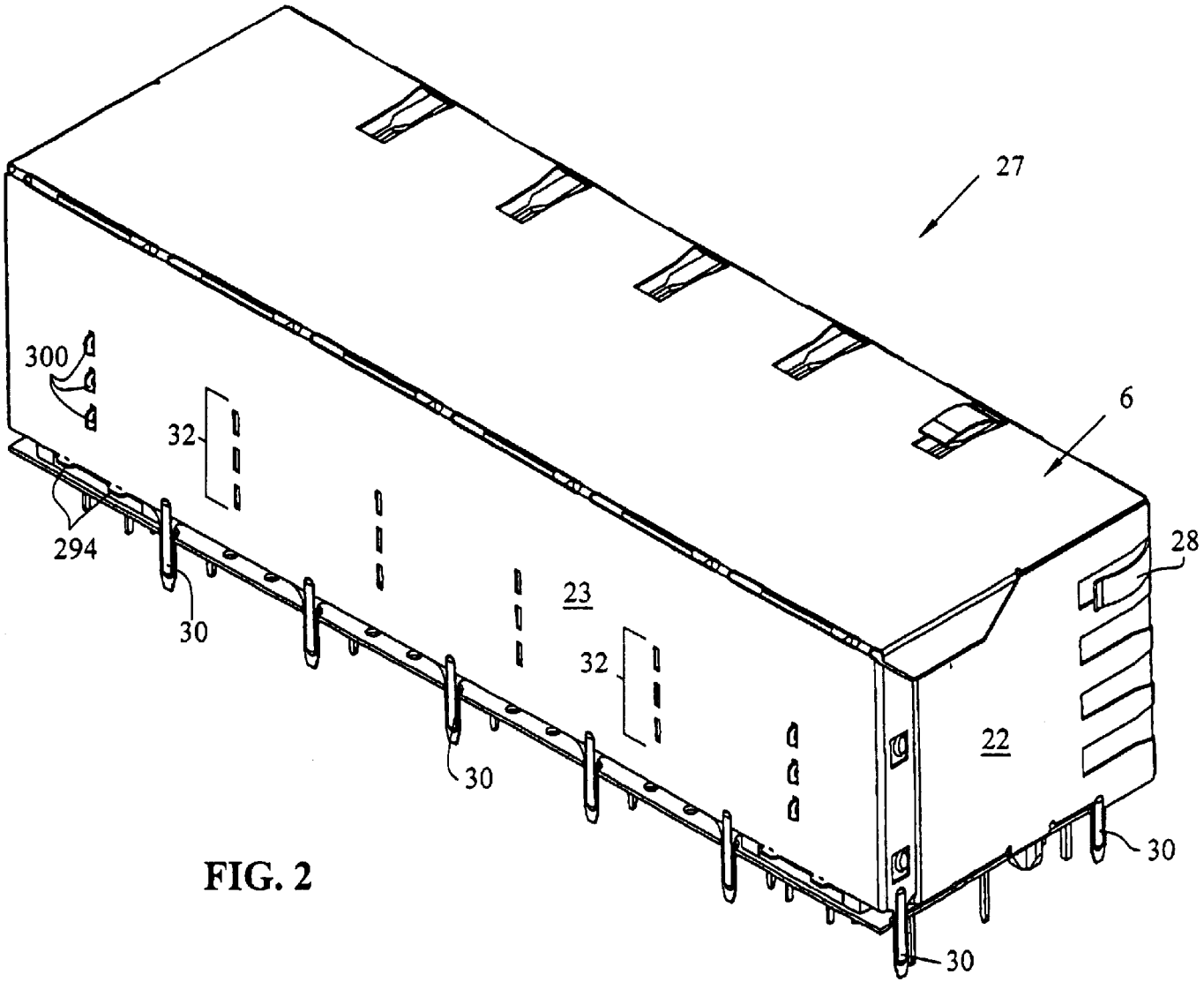
FIG. 2 shows a perspective view of the device of FIG. 1 from the rear side thereof.

With respect first to FIGS. 1 and 2, a multiple "stacked jack" electrical connector assembly is depicted at 2. This assembly generally comprises an inner housing at 4 comprised of an insulative material, where the housing 4 is substantially surrounded by a metallic shield at 6. As shown best in FIG. 1, the stacked jack assembly provides a plurality of ports at 8, which are configured for receiving modular plugs, which are well known in the art.

Figure 3:
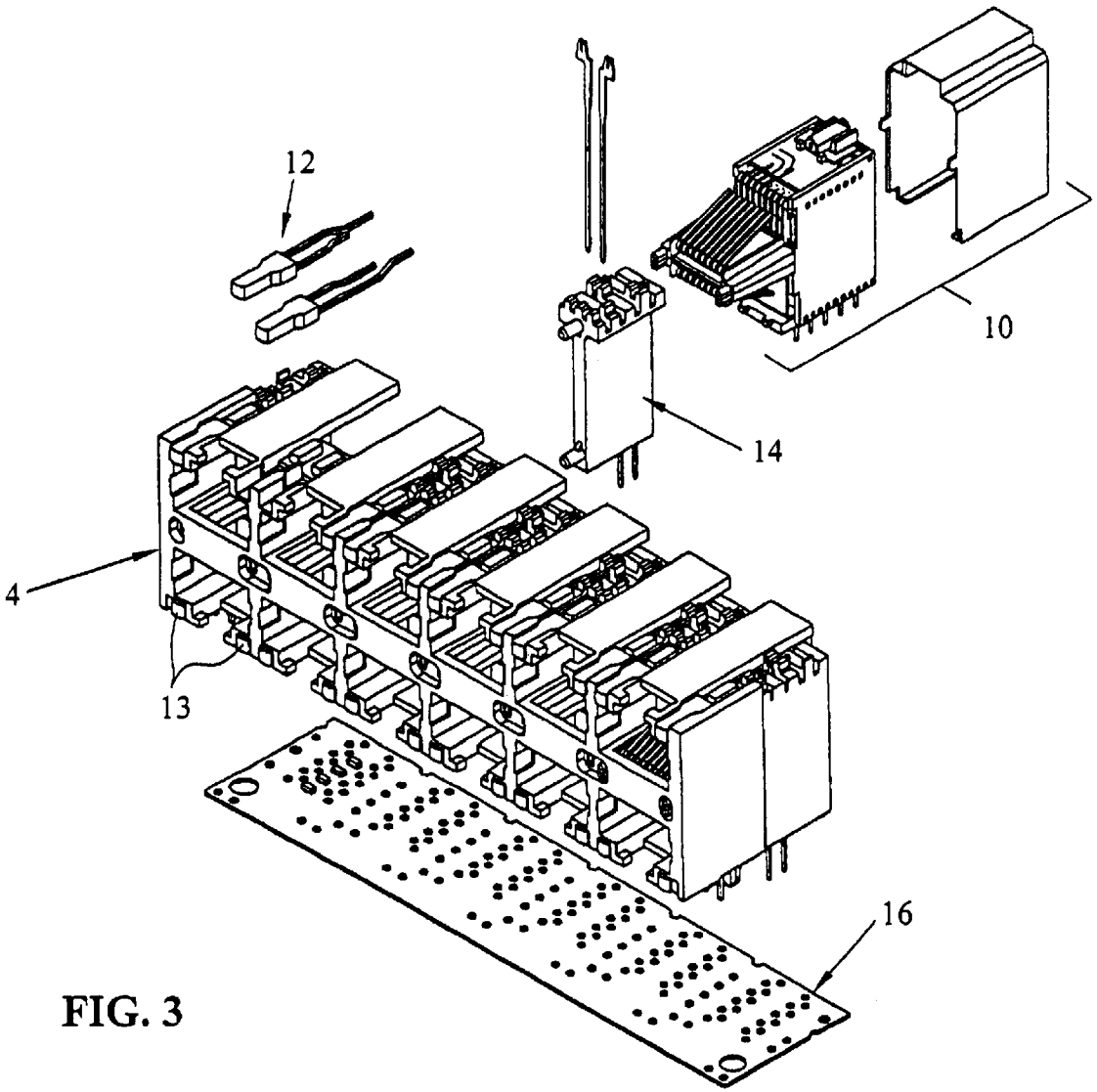
FIG. 3 shows an exploded view of the components of the multiple port assembly of FIG. 1, less the outer shielding.

With respect now to FIG. 3, the assembly 2 is shown exploded, less the outer shielded housing 6. The assembly includes the housing 4, a plurality of jack modules 10, a plurality of LEDs 12, and a plurality of LED modules 14. Finally, the assembly includes a lower printed circuit board at 16. With the general componentry of the assembly 2 herein described, the individual components will now be further described in relation to the drawings.

With respect again to FIGS. 1 and 2, the outer shield 6 is comprised of an upper wall 20, side walls 21 and 22 (FIG. 2), rear wall 23, and a front face portion 24. The front face 24 includes a plurality of openings 25 corresponding with the location and number of ports for each of the multiple openings 8. As is also shown in FIG. 1, shield 6 includes commoning springs 26 extending from top wall 20, commoning springs 27 and 28 (FIG. 2) extending from respective side walls 21 and 22, and commoning springs 29 extending from side edges of openings 25. As shown best in FIG. 2, shield assembly 6 further includes a plurality of grounding tines 30 extending downwardly therefrom, as will be described in greater detail herein. It should also be noted that rear wall 23 includes a plurality of tab slots 32, which will also be further described herein.

Figure 4:
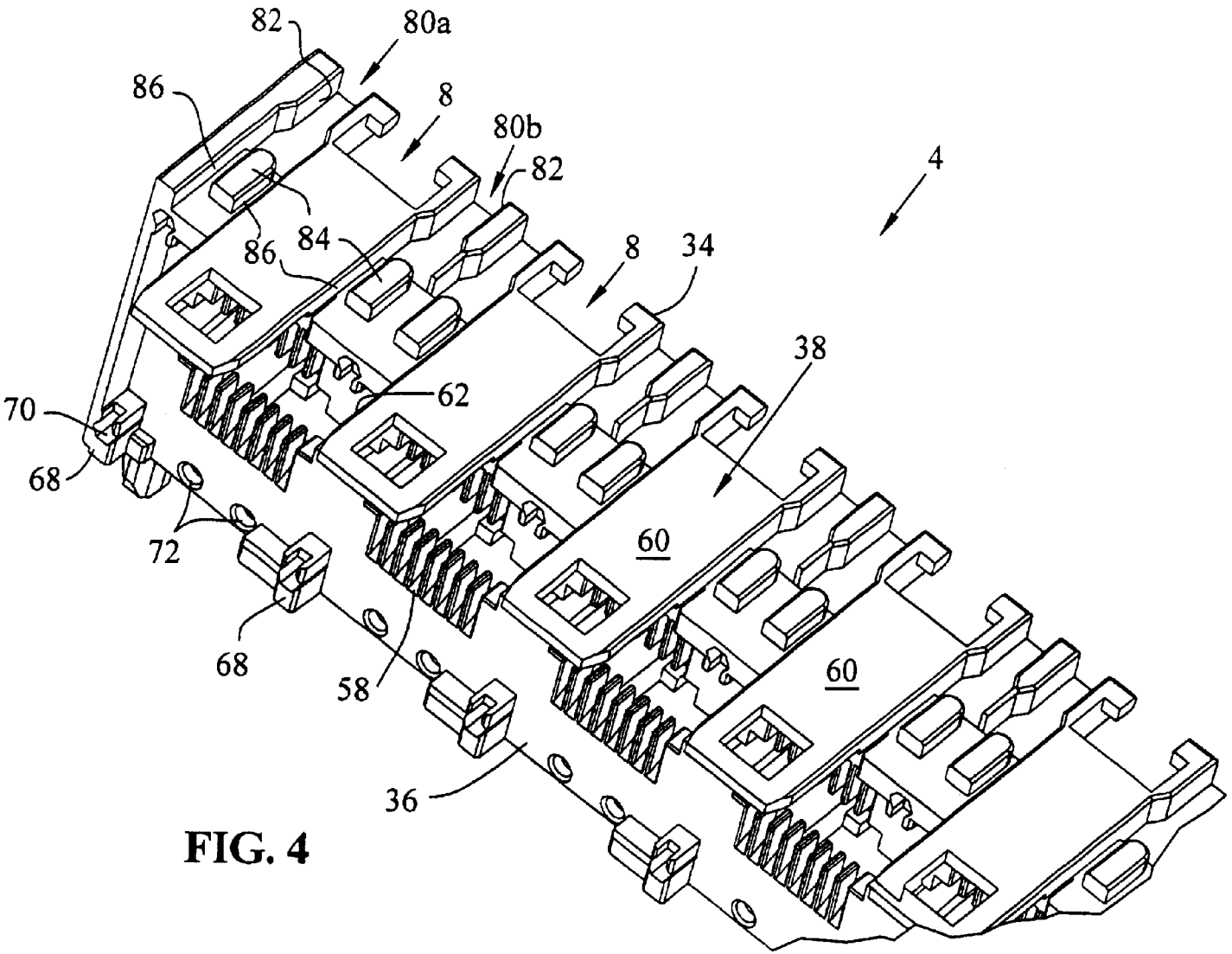
FIGS. 4 and 5 show rear perspective views of the housing of FIG. 3.

With respect now to FIGS. 4–6, the inner housing 4 will be described in greater detail. As shown in FIG. 4, housing 4 includes a front face at 34, rear wall 36, top wall 38, and lower wall 40 (FIG. 6). As shown best in FIG. 6, the plurality of ports 8 are partially defined by, and extend through, front face 34.

Figure 5:
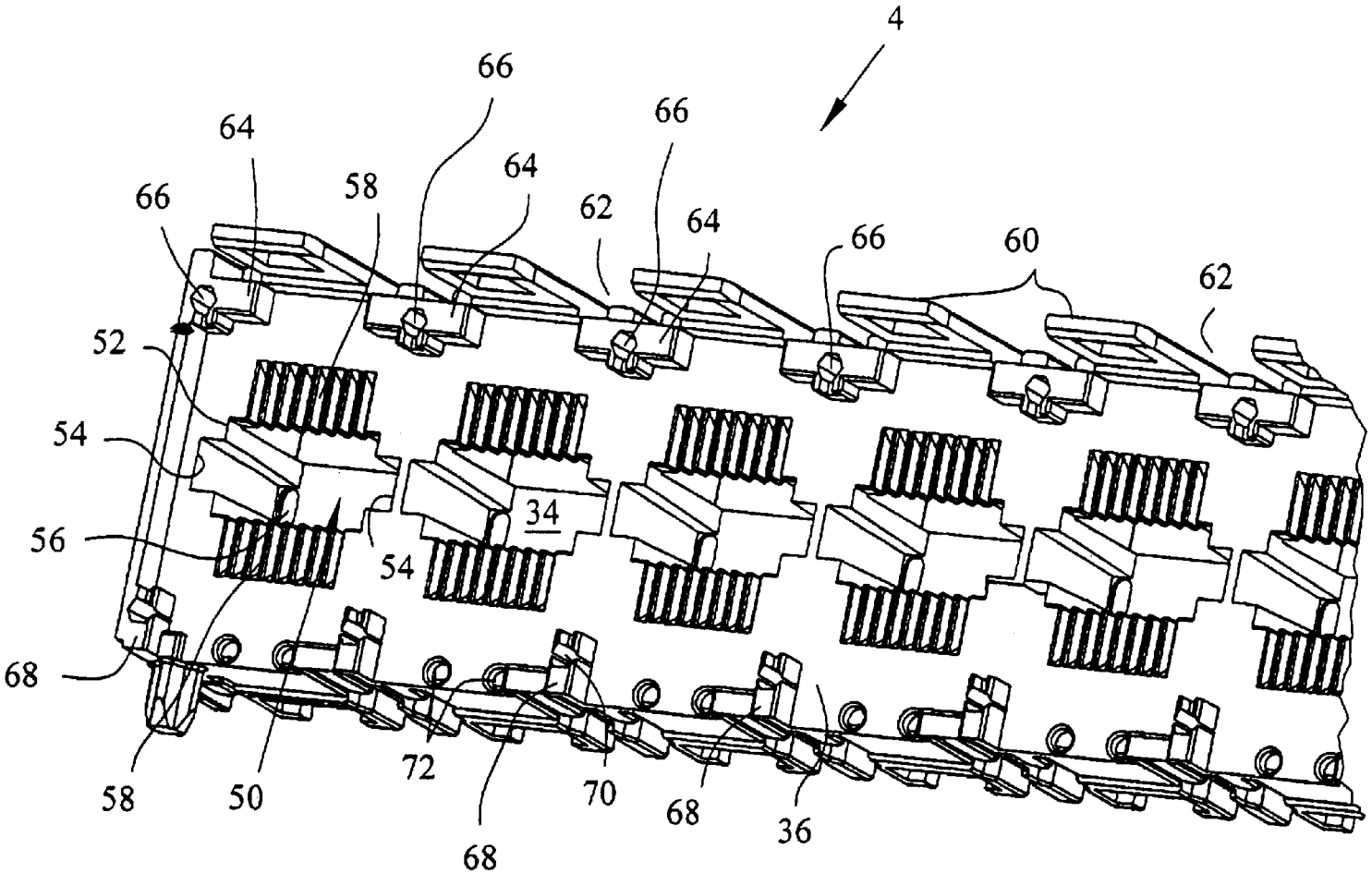
Figure 6:
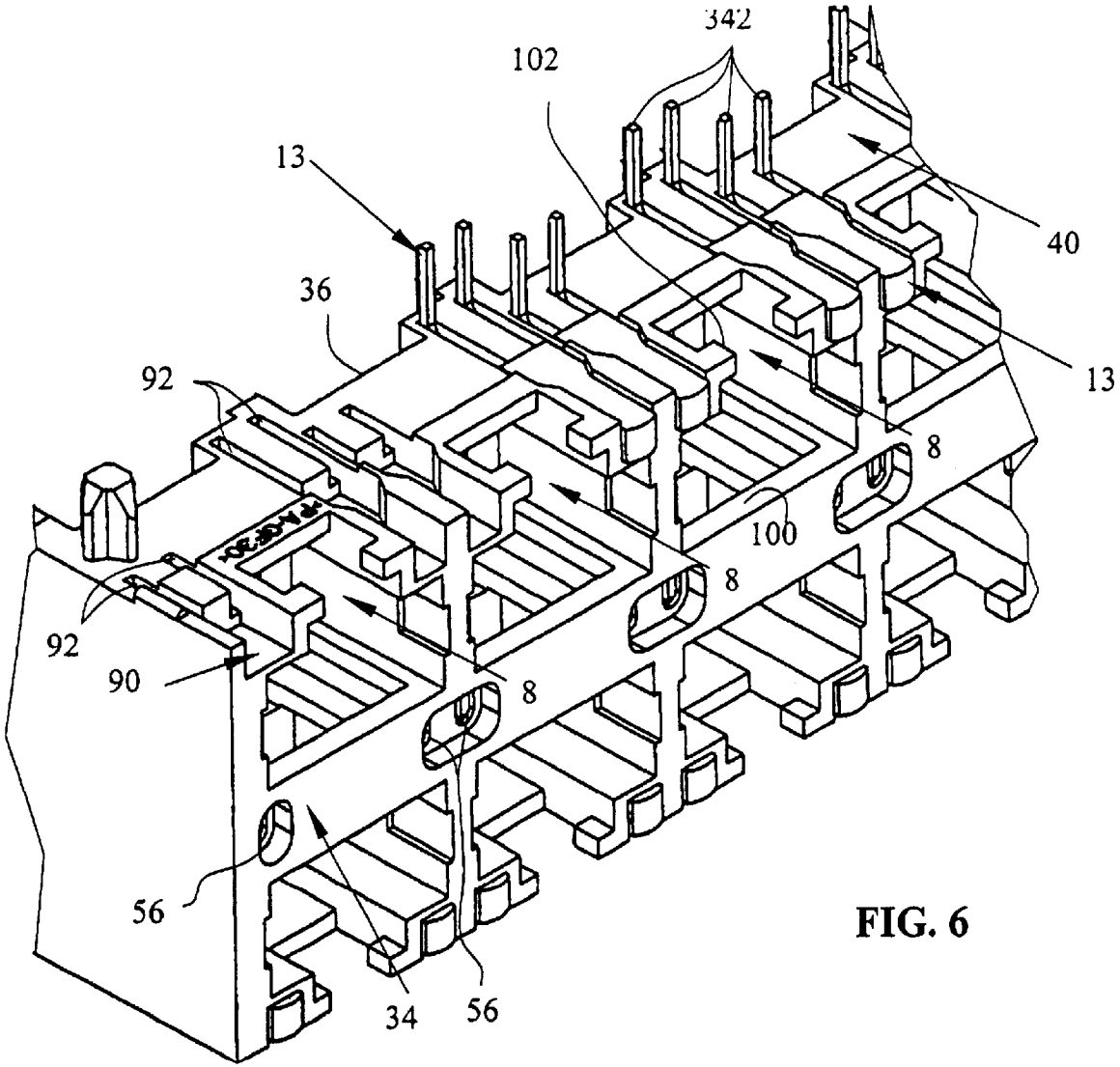
FIG. 6 shows a front perspective view of the housing of FIG. 4 or 5.

With respect now to FIG. 5, the rear of housing 4 is shown in greater detail, where a plurality of openings 50 are shown where, for each location of opening 50, two ports 8 are defined at the front face 34. As shown in FIG. 5, each opening 50 is defined by side walls 52, where each of the side walls includes a channel 54, where the channel necks down progressively, as will be described in further detail. At the end of each of the channels 54, openings 56 are provided, which project through front face 34, and which are also depicted in FIG. 6. Two such openings 56 are provided for each of the openings 50. Openings further include comb-like contact aligning mechanisms 58, where one comb-like aligning mechanism is provided for each modular jack port 8, that is, two per opening 50.

As also shown in FIG. 5, housing 4 includes a plurality of wall extensions, such as 60, extending rearwardly from the rear face 36, whereby the wall extensions define apertures 62 intermediate the extensions, and for each aperture 62, an aligning land 64 is provided having an aligning aperture at 66. The lower side of housing 4 also includes a plurality of lands 68, each land having an aligning opening at 70. The lower portion of housing 4 further includes a plurality of centrally located aligning apertures 72, as will be described further herein.

With respect now to FIGS. 4 and 6, housing 4 is also provided with a plurality of LED-receiving channels, as will be described herein. With respect first to FIG. 4, top wall 38 of housing 4 is provided with two channels 80 for each top port 8. For example, as shown in FIG. 4, LED channels 80A and 80B are provided for a first port 8, where each of the channels 80A and 80B includes an LED-receiving section 82 and lands 84 providing lead-receiving channels at 86. It should be appreciated that each port 8 would include two such LED-receiving sections and it should also be appreciated that the lead-receiving channels at 86 are generally aligned with the openings 62 defined between top wall extension portions 60.

With respect now to FIG. 6, lower wall 40 also includes LED-receiving channels at 90, with each LED-receiving channel including lead-receiving channels at 92. Finally, with respect still to FIG. 6, it should be appreciated that each of the ports 8 in the housing are defined by openings 100 through front wall 34, where each opening 100 is provided with a latching structure, such as T-shaped latching structure 102 for receipt of a modular plug latch as is well known in the art.

Figure 7:
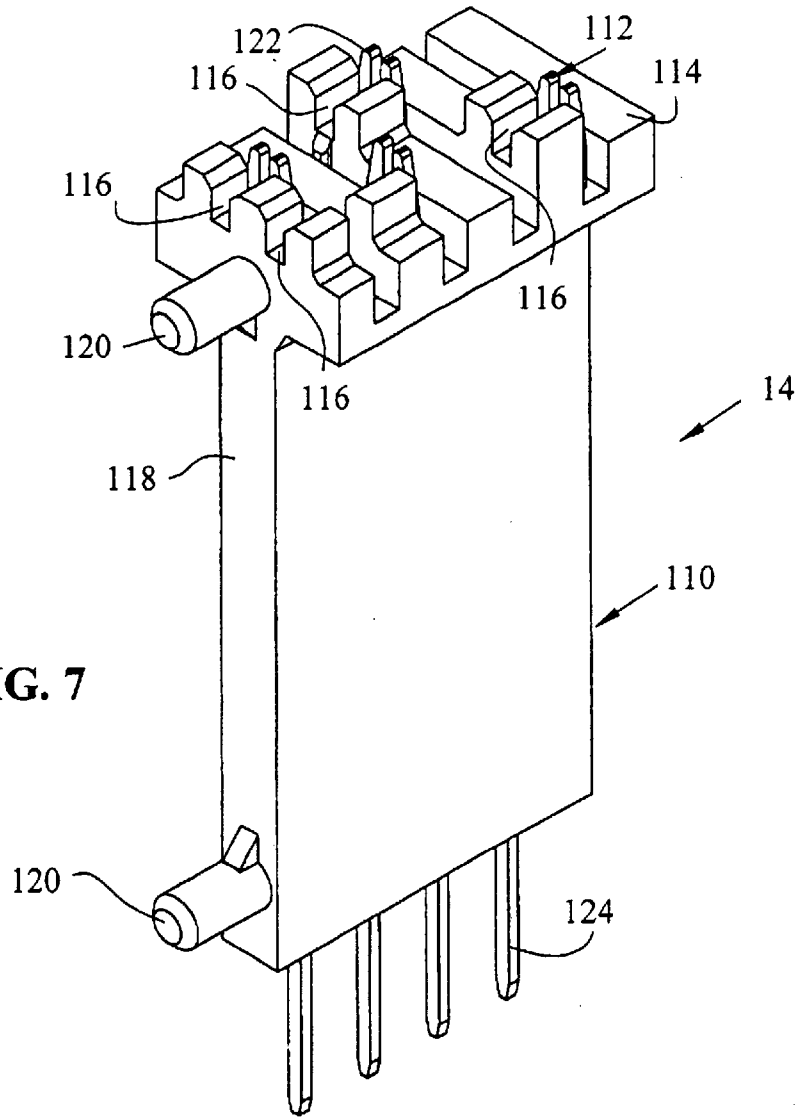
FIG. 7 shows an enlarged perspective view of the LED module.

With respect now to FIG. 7, LED modules 14 will be described in greater detail, where each LED module 14 includes module housing 110 and terminals 112. LED module housing 110 includes an upper lead receiving section 114 comprised of lead receiving channels at 116 in alignment with each of the terminals 112. The leading edge 118 of the module housing 110 includes aligning posts 120, where the linear distance between the posts 120 is chosen to match the linear distance between respective pairs of apertures 66, 70 (FIG. 5). Terminals 112 include termination section 122 and lead sections 124. Termination sections 122 simulate an insulation displacement contact (IDC) portion to receive the LED leads.

Figure 8:
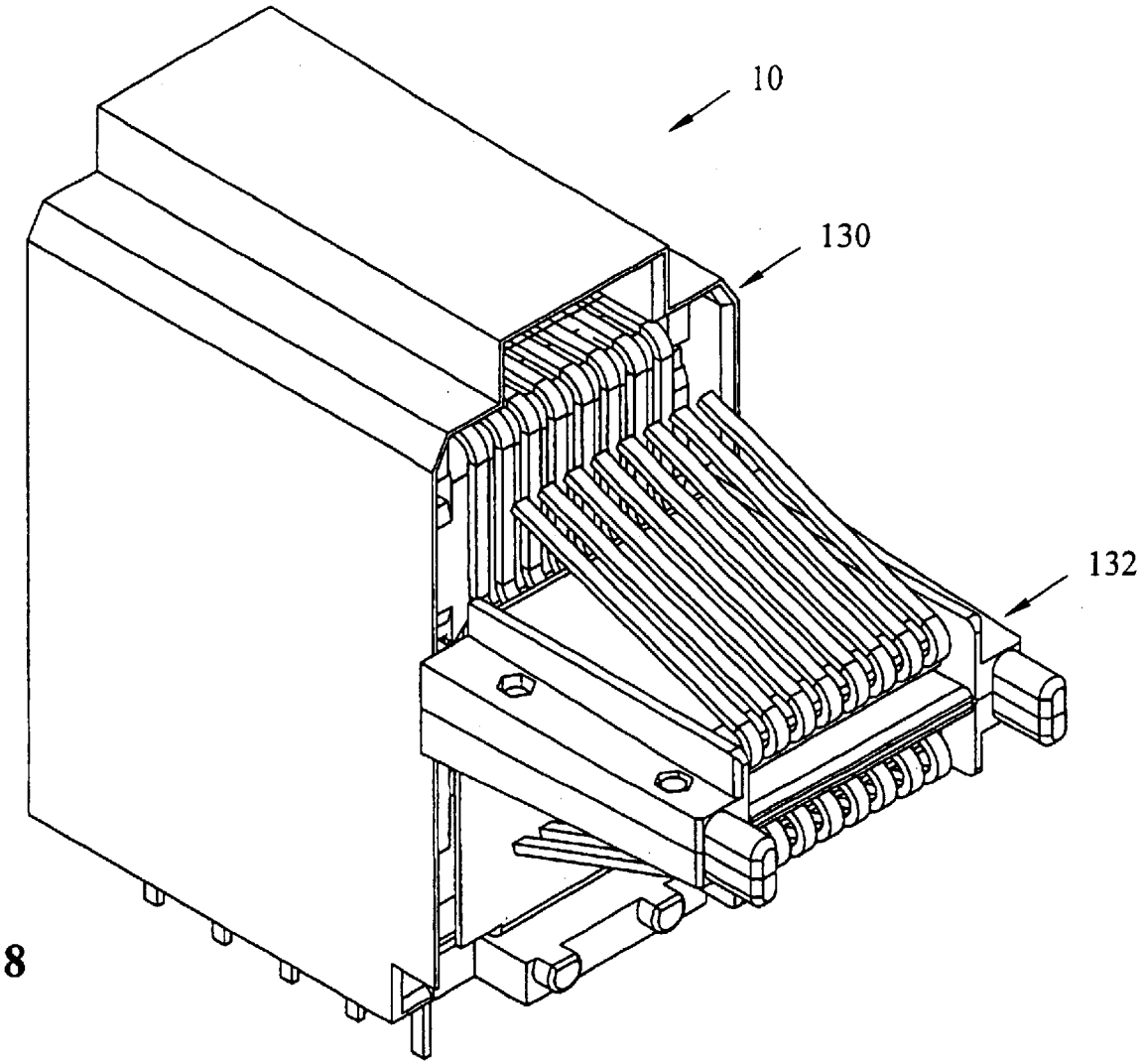
FIG. 8 shows a front perspective view of the double modular jack module.
Figure 9:
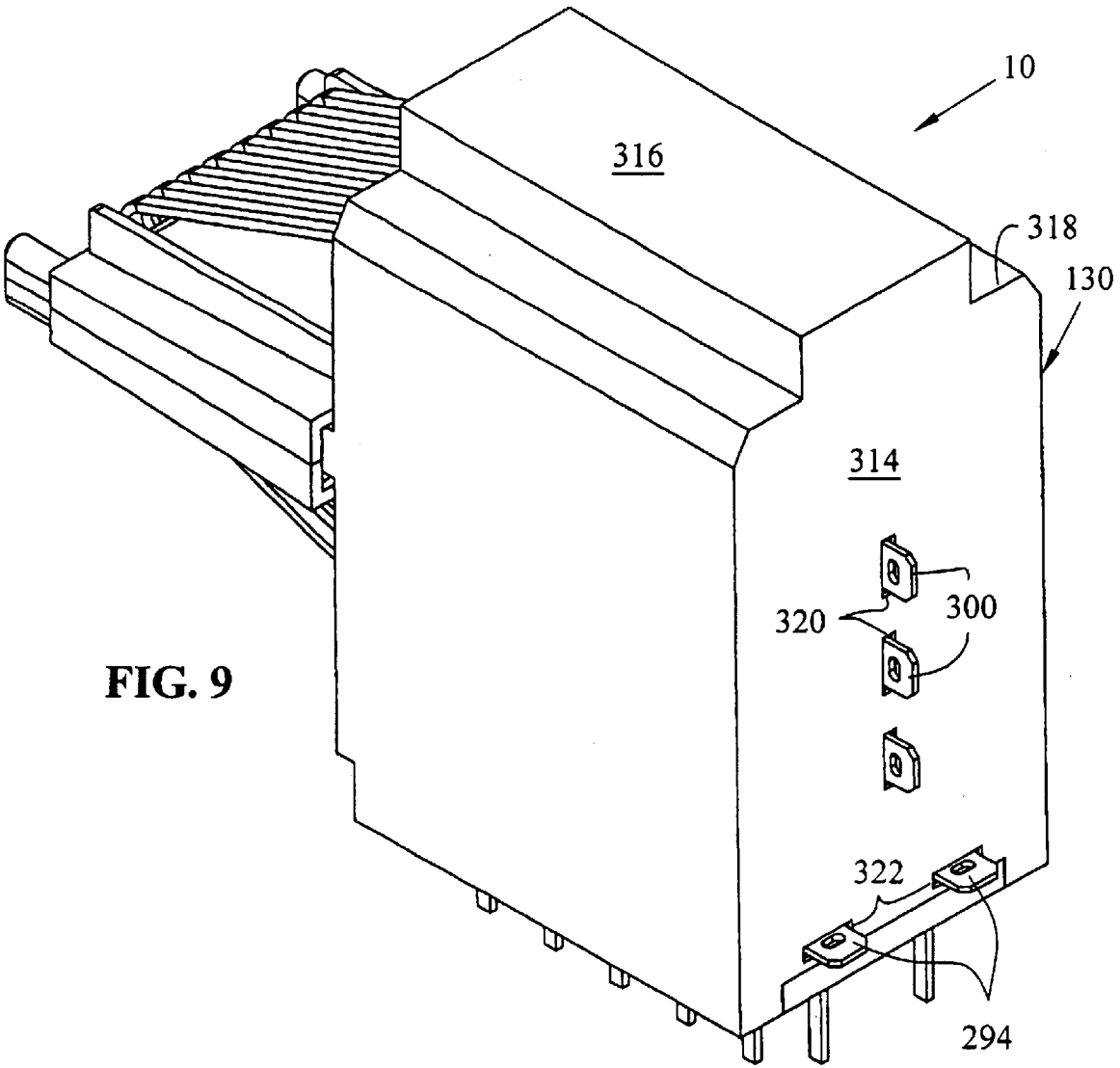
FIG. 9 shows a rear perspective view of the module of FIG. 8.
Figure 10:
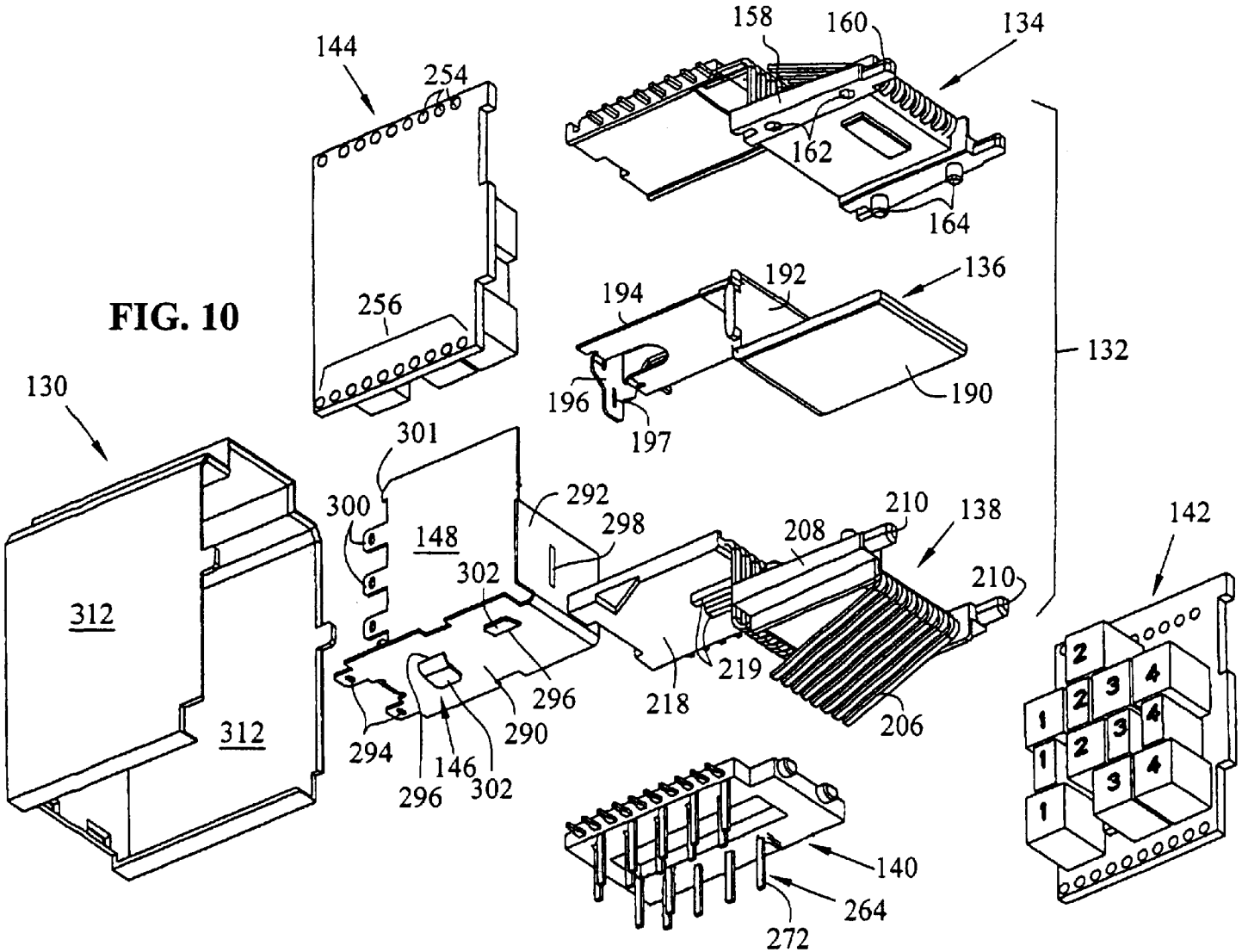
FIGS. 10 and 11 show exploded views of the module of FIGS. 8 and 9.

With respect now to FIGS. 8–10, the jack modules 10 will now be described in greater detail. As shown best in FIG. 8, the jack module 10 includes an outer insulative housing shown at 130 holding a jack subassembly 132. As shown in FIG. 10, jack subassembly 132 is generally comprised of an upper jack portion 134, an intermediate shield at 136, and a lower jack portion at 138. As also shown in FIG. 10, jack module 10 further includes a lower housing portion 140, component boards 142, 144, and shield members 146, 148.

With respect now to FIG. 12, the jack subassembly 132 will be described in greater detail. Upper jack portion 134 is comprised of an insulative housing portion 150 and a lead frame 152. Housing 150 is comprised of a central housing portion 154, which over-molds a portion of the lead frame 152, such that free end portions 156 of the lead frame extend from a front end thereof, and are reversely bent to define the modular jack contacts. At the side edges of the central housing portion 154 are alignment ribs 158 having alignment posts 160 extending outwardly therefrom, where one alignment rib 158 includes apertures 162, and the other alignment rib 158 includes posts 164 (see FIG. 10).

Figure 12:
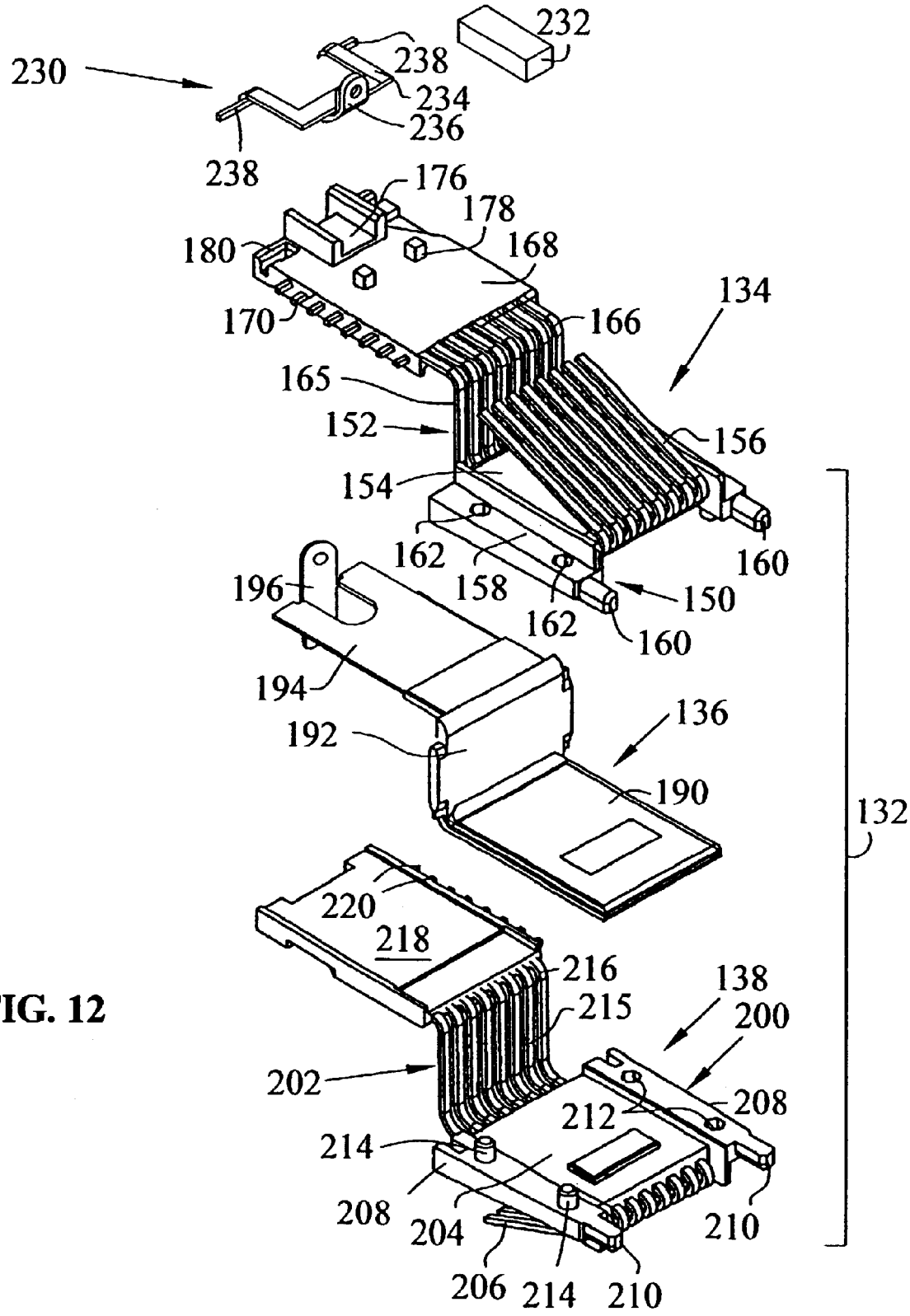
FIG. 12 shows an enlarged view of the module jack components shown in FIG. 11.

With respect still to FIG. 12, lead frame 152 extends from a rear portion of housing 154 to project upwardly to define terminal sections 165 and are again bent rearwardly to define terminal sections 166. Terminal sections 166 are over-molded in rear housing portion 168 and exit at a side edge to define printed circuit board tine sections 170. Rear housing portion 168 further includes a component-receiving channel at 176, aligning posts 178 and channels 180, as will be further described herein.

With respect still to FIG. 12, center ground plane 136 is substantially Z-shaped and is over-molded to form plastic web portion 190 and upstanding web portion 192, yet is exposed at rear portion 194. Portion 194 includes an integrally stamped tab portion 196, which is stamped from the plane of the material of 194 and then twisted about its side edges to form an upstanding tab as shown.

As shown in FIG. 12, the lower jack housing 138 is generally comprised of housing portion 200 and lead frame 202. Housing portion 200 includes central housing portion 204, which integrally encapsulates a portion of lead frame 202 therein. Lead frame 202 extends from a front end of housing portion 204, where they are reversely bent downwardly to define terminals 206 profiled as modular jack contacts. Housing portion 204 further includes two aligning ribs 208 positioned on each side thereof, where each aligning rib 208 includes a post 210 at the front end thereof, and where one rib 208 includes apertures 212 and the opposite rib 208 includes aligning posts 214.

Lead frame 202 extends from a rear edge of housing portion 204 and is bent vertically so as to define terminal sections 215 and are again bent to a horizontal position to define terminal sections 216. Lead frame sections 216 are over-molded by housing portion 218 and have sections 220 extending therefrom defining printed circuit board receiving tines.

With respect yet to FIG. 12, a grounding clip 230 is shown for interconnection to a passive component 232, such as a decoupling capacitor. Clip 230 includes a U-shaped member 234 having a grounding tab 236 extending upwardly therefrom, and grounding tines 238 extending from opposite sides thereof.

With respect again to FIGS. 10 and 11, component boards 142 and 144 will be described in greater detail. Each of the boards includes a printed circuit board 250 and a plurality of components 252. In this version of the invention, three magnetic coils are positioned on the board for each terminal. That is, those components labeled with numeral 1 are for terminal 1, those labeled with numeral 2 are for terminal 2, etc. Also in this version of the invention, the three coils for each terminal are serially connected and connected to a respective throughhole 254 at one end and to throughhole 256 at the other end.

Figure 11:
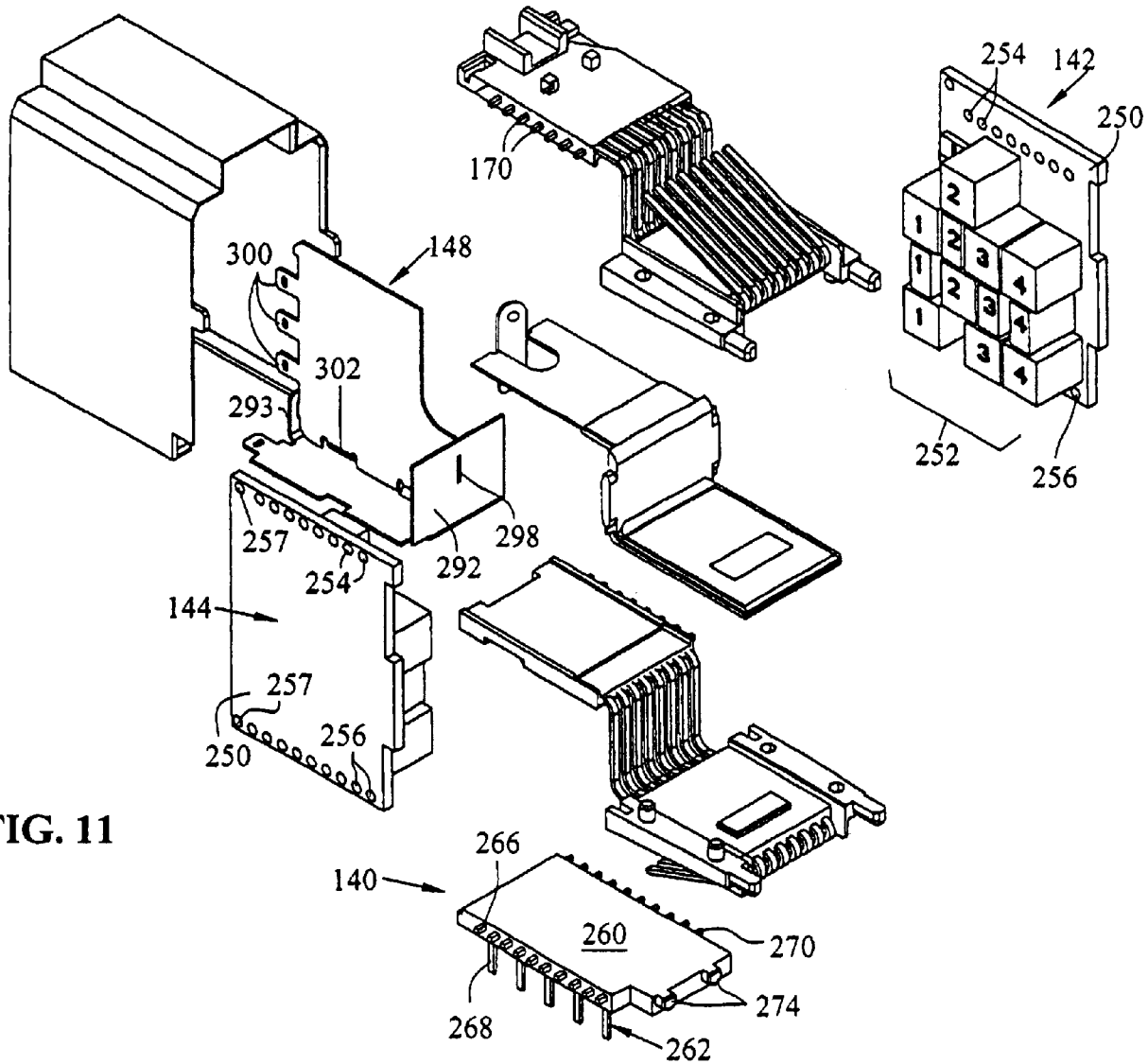

Also with respect to FIGS. 10 and 11, lower housing portion 140 includes a housing portion 260 encapsulating a plurality of contacts 262 and 264. Contacts 262 include printed circuit board portions 266 extending from a side edge of housing 260 and printed circuit board portions 268 extending downwardly from housing portion 260. Likewise, terminals 264 include printed circuit board portions 270 extending outwardly from housing portion 260, and printed circuit board portions 272 extending downwardly from housing portion 260. Alignment pegs 274 are positioned at front edge of housing portion 260, as will be described herein.

Figure 13:
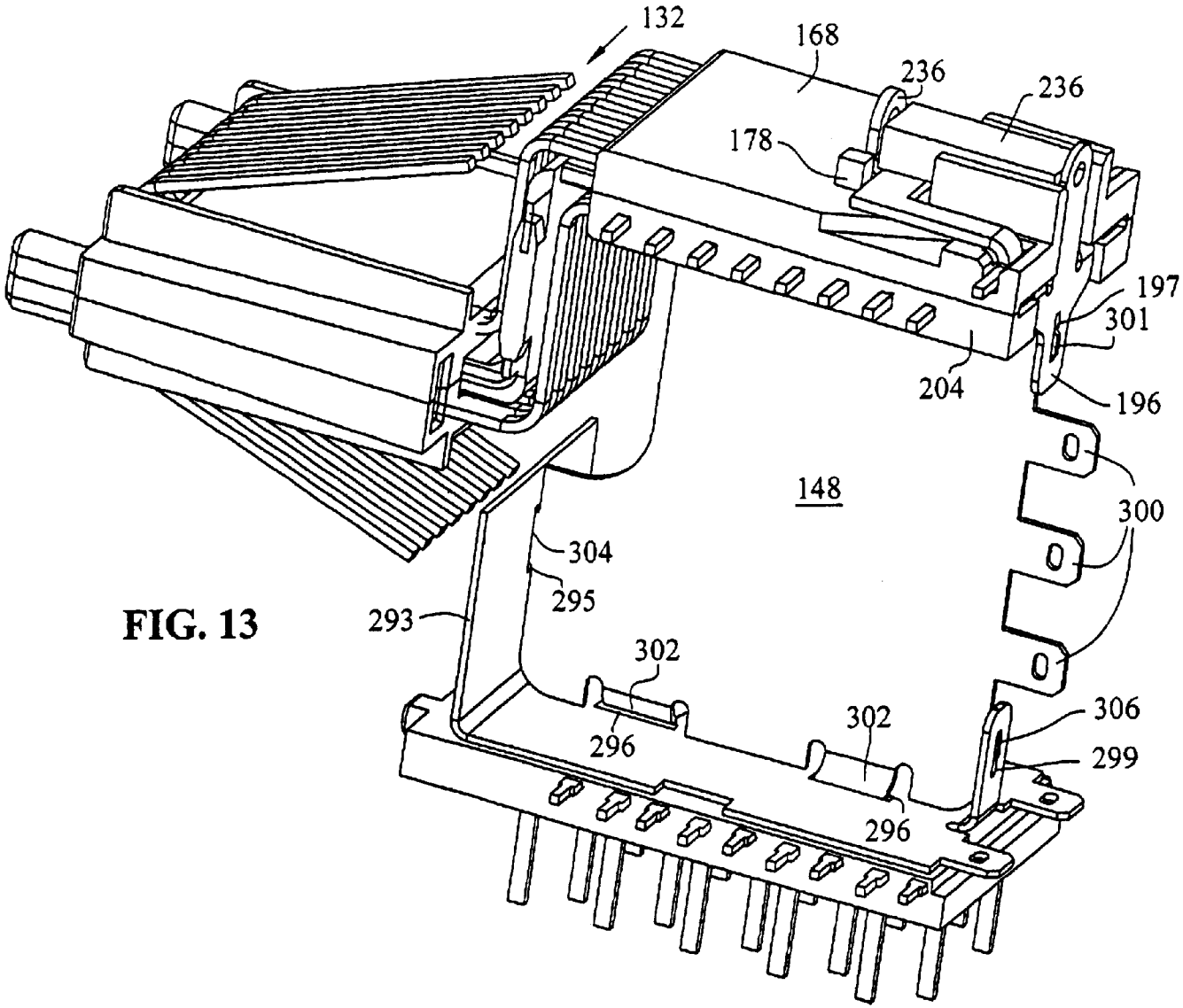
FIG. 13 shows a partially assembled perspective view of the module less the magnetic components and outer housing.

With respect still to FIGS. 10 and 11, shield members 146 and 148 will be described herein. Shield member 146 is L-shaped including a lower plate portion 290 and a transverse section at 292. Lower section 290 includes grounding tabs 294 extending rearwardly therefrom and through slots at 296. Lower section 290 further includes an upstanding tab at 293 (FIG. 11) having a slot opening at 295 (FIG. 13). Meanwhile, shield portion 292 includes a through slot at 298. Shield member 148 includes tabs 300 and 301 extending from a rear edge, tabs 302 extending from a lower edge, and tab 304 extending from a front edge thereof (FIG. 13).

With respect now to FIGS. 9 and 10, insulative housing 130 will be described in greater detail. Housing 130 includes side walls 312, rear wall 314 and top wall 316. Top wall 316 is raised relative to a wall portion 318 for clearance purposes, as will be more fully understood herein. Finally, housing 130 includes apertures 320 and 322 through the rear wall 304 for receipt of tabs 294 and 300.

With the components described as above, the assembly will now be described. With reference first to FIG. 12, the upper and lower contact portions 134 and 138 are positioned adjacent to the intermediate cross-talk shield member 136. It should be appreciated that the corresponding posts and apertures 164, 212 and 214, 162 are positioned together, thereby aligning the two housing portions 154 and 204 together, and trapping the shield therebetween. This also aligns corresponding front post members 160 and 210 together, to form one oval post. When in this position, printed circuit board portions 170 extend from one side edge of housing 168, whereas printed circuit board portions 220 extend from the opposite side of housing portion 218. The grounding clip 230 is now positioned relative to housing portion 168, with U-shaped clip section 234 being positioned on the inside of posts 178, with the printed circuit board portions 238 being positioned in respective channels 180. This positions tab portions 196 and 236 spanning across the component receiving channel 176, such that component 232 can be positioned between the two tab portions 196 and 236. The component is soldered in place to form a permanent electrical connection.

Figure 14:
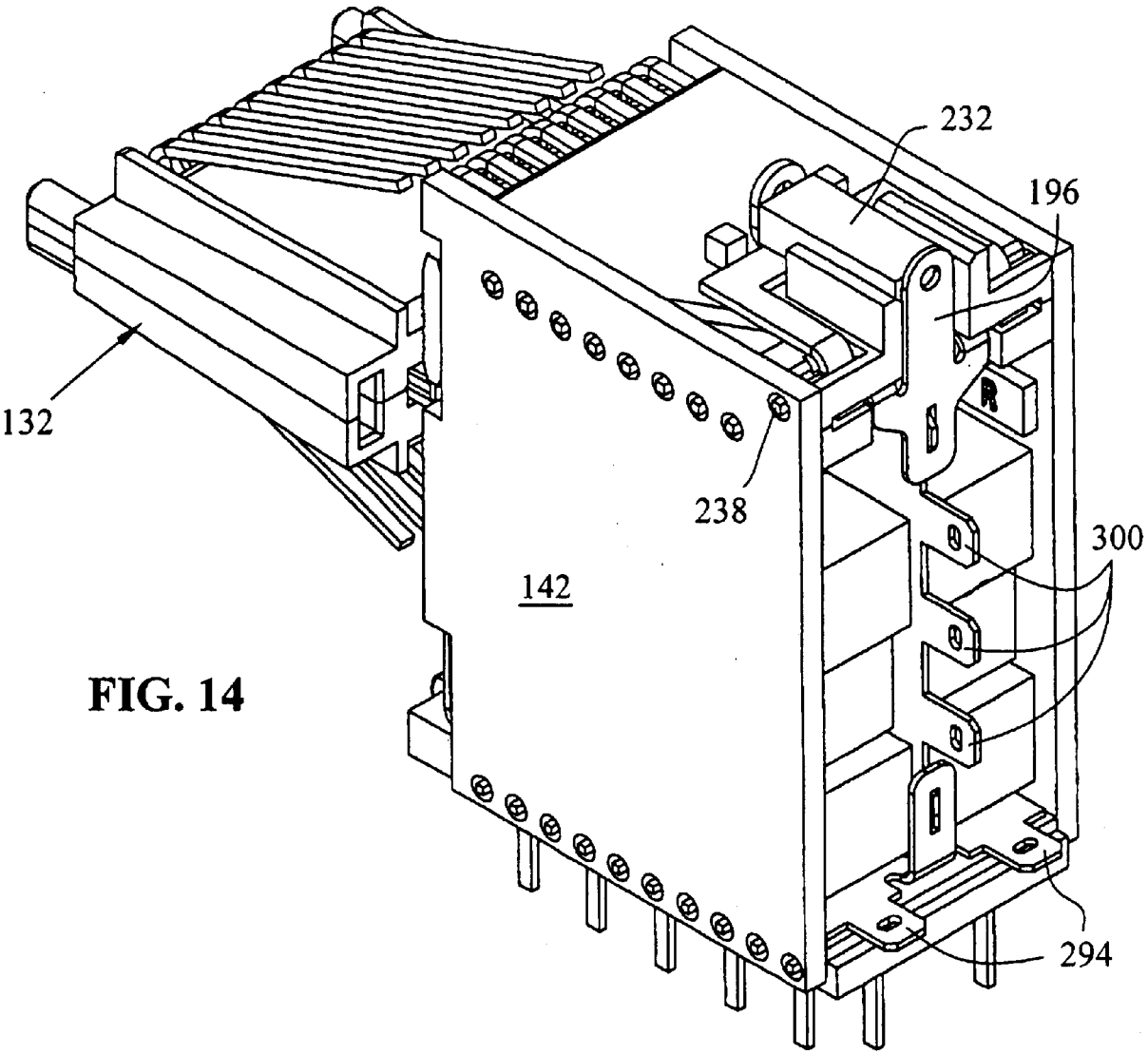
FIGS. 14 and 15 show perspective views similar to that of FIG. 13, including the side-loaded printed circuit cards having the magnetic components thereon.
Figure 15:
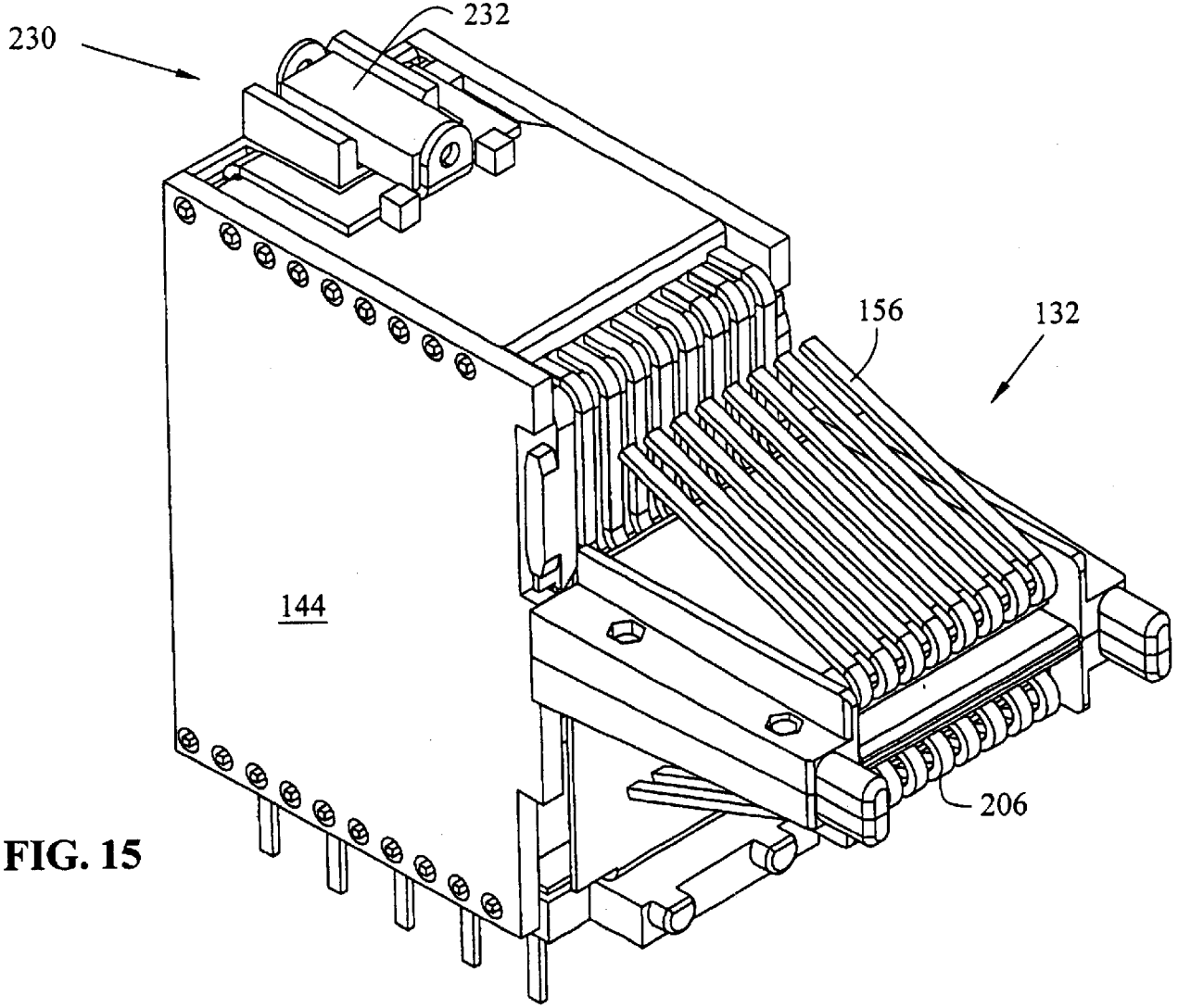

Intermediate shield 148 is now assembled together with shield 146, such that tab 306 is positioned in slot 299 and tab 304 is positioned in slot 295, as best shown in FIG. 13. This also positions tabs 302 through slots 296, where they can be bent back adjacent to an underside of plate portion 290, as best shown in FIG. 10. The assembled terminal subassembly 132 can now be positioned relative to intermediate shield 148 by positioning slot 197 over tab 301 (FIG. 13) and by placing alignment ribs 219 over the top edge of shield 148 (FIG. 10). With the terminal subassembly 132 and shields as assembled in FIG. 13, the printed circuit boards 142 and 144 carrying the magnetic components can now be positioned such that the respective apertures 254, 256 are overlapping their respective contacts 170, 266 and 220, 270 (FIGS. 11 and 12). This positions the assembly into the configuration shown best in FIGS. 14 and 15. It should be noted that grounding tines 238 are extending through a respective throughhole 257, where it is grounded through a trace on the board. Housing 130 can now be slidably received over the entire assembly of the terminal subassembly 132 and shields, such that tabs 300 protrude apertures 320 and tabs 294 protrude apertures 322, as best shown in FIG. 9.

Figure 16:
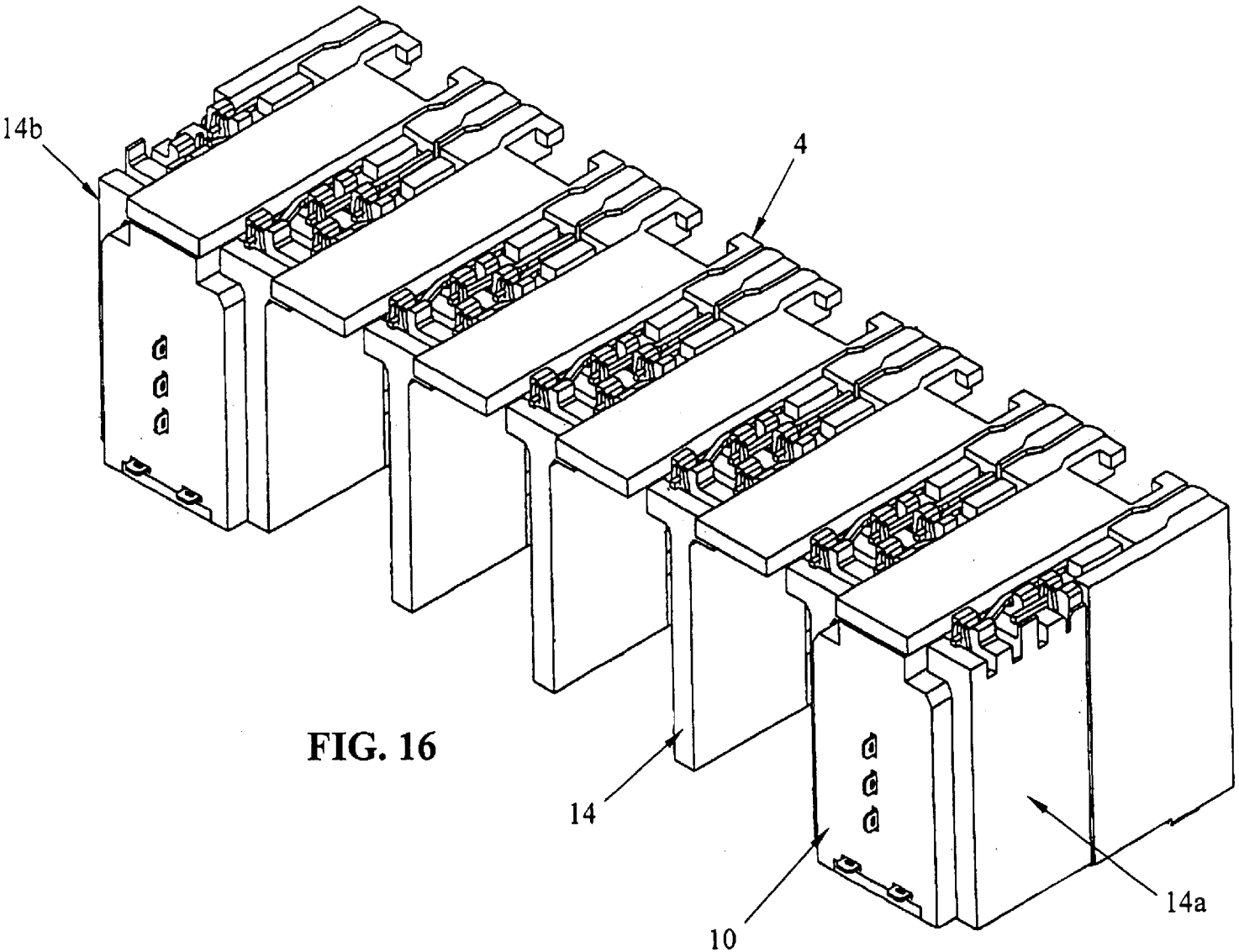
FIG. 16 shows a rear perspective view showing the housing loaded with the LED modules, and partially loaded with jack assembly modules.

With respect now to FIG. 16, the LED modules 14 can now be positioned in place within housing 4. Each LED module 14 (FIG. 7) is positioned such that posts 120 are aligned with corresponding apertures 66 and 70 (FIG. 5), which positions the upper housing portion 114 within apertures 62, that is, intermediate adjacent housing extensions 60. It should also be appreciated that a right (14A) and left (14B) LED module are required for the end of the housing, as these LED modules only carry a singular LED. With the LED modules in place, the individual LEDs 12 can be positioned in their corresponding channels 80. The LED leads are positioned around posts 84 (FIG. 4) and into channels 116 (FIG. 7), and are electrically interconnected to terminal sections 122. This electrically interconnects the LED leads with the leads 124 (FIG. 7), which extend downwardly therefrom. The lower row of LEDs 13 may now be positioned in their respective channels 90 (FIG. 6) with the leads extending in their respective channels 92.

The plurality of modules 10 may now be positioned within the housing member 4 into the position shown in FIG. 16. It should also be appreciated from viewing FIG. 16 that the plurality of LED modules 14, 14A, 14B form side wall continuations for the alignment of not only the LEDs, but also the modules 10. The modules 10 are positioned within the housing as shown in FIG. 16, such that the corresponding posts 160, 210 extend through the corresponding openings 56 (FIG. 17), whereupon the posts can be heat-staked or otherwise receive a fastener to retain the subassemblies therein. It should also be understood that corresponding ribs 158, 208 (FIG. 12) are received in channels 54 (FIG. 5) to align the subassemblies within the openings 50. This also positions terminal 156, 206 (FIG. 12) with the comb-like alignment members 58 (FIG. 5) to hold them in side-by-side non-contacting relation.

Figure 17:
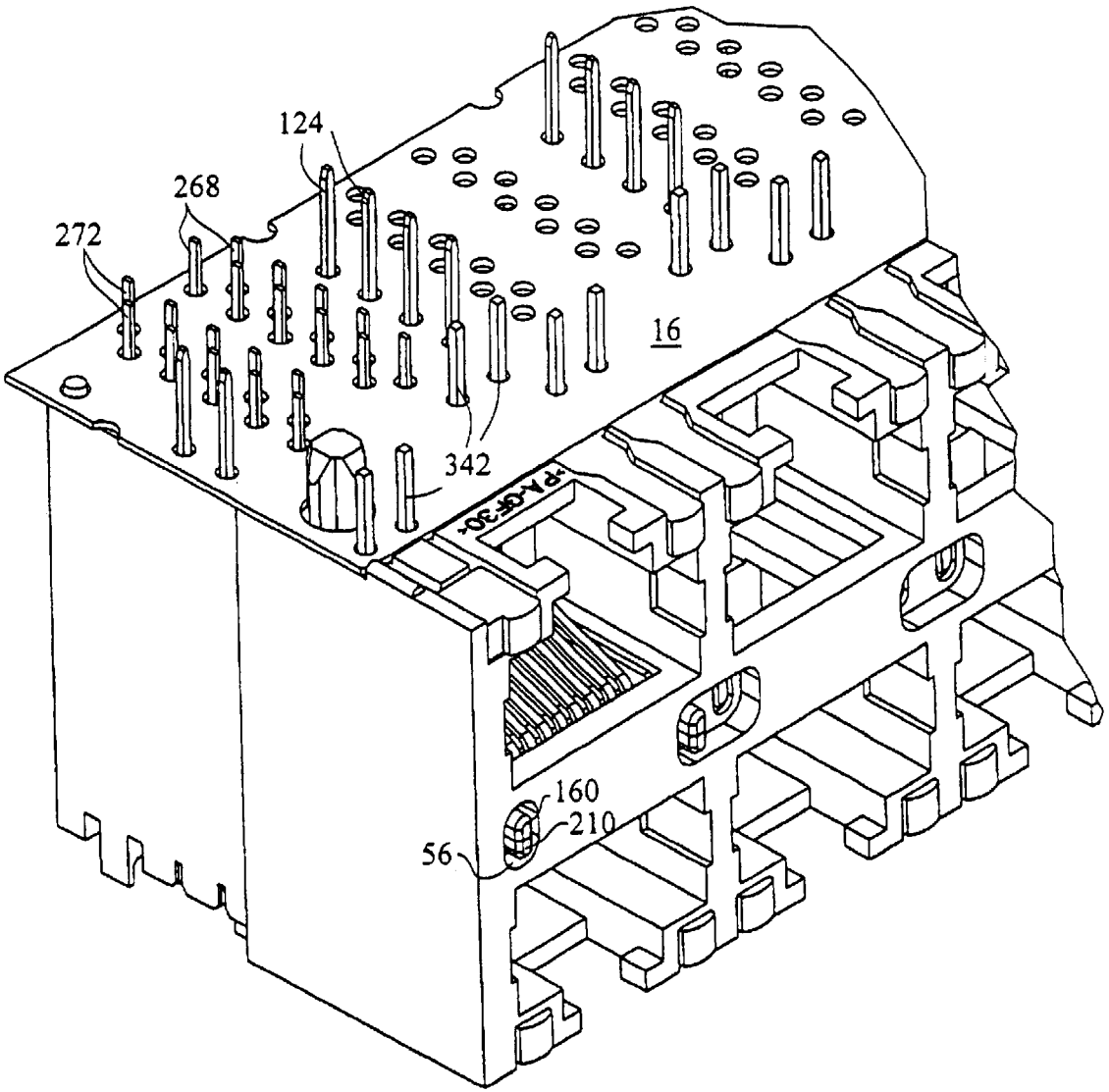
FIG. 17 shows a lower perspective view of the housing with the lower terminal plate in place.

When all of the terminal modules 10 are loaded within their respective positions, printed circuit board 16 can be positioned over the plurality of terminals, that is, printed circuit board terminals 268 and 272 (FIGS. 10 and 11), which are the corresponding printed circuit board terminals for modular jack terminals 156, 206 and upper LED contacts 340 and lower LED contacts 342. With the multi-port connector assembled as shown in FIG. 17, the outer shield 6 may now be positioned in an overlapping relation to housing 4, such that tabs 300 (FIG. 14) extend through apertures 32 and tabs 294 (FIG. 14) extend beneath back wall section 23, as best shown in FIG. 2.

Figure 18:
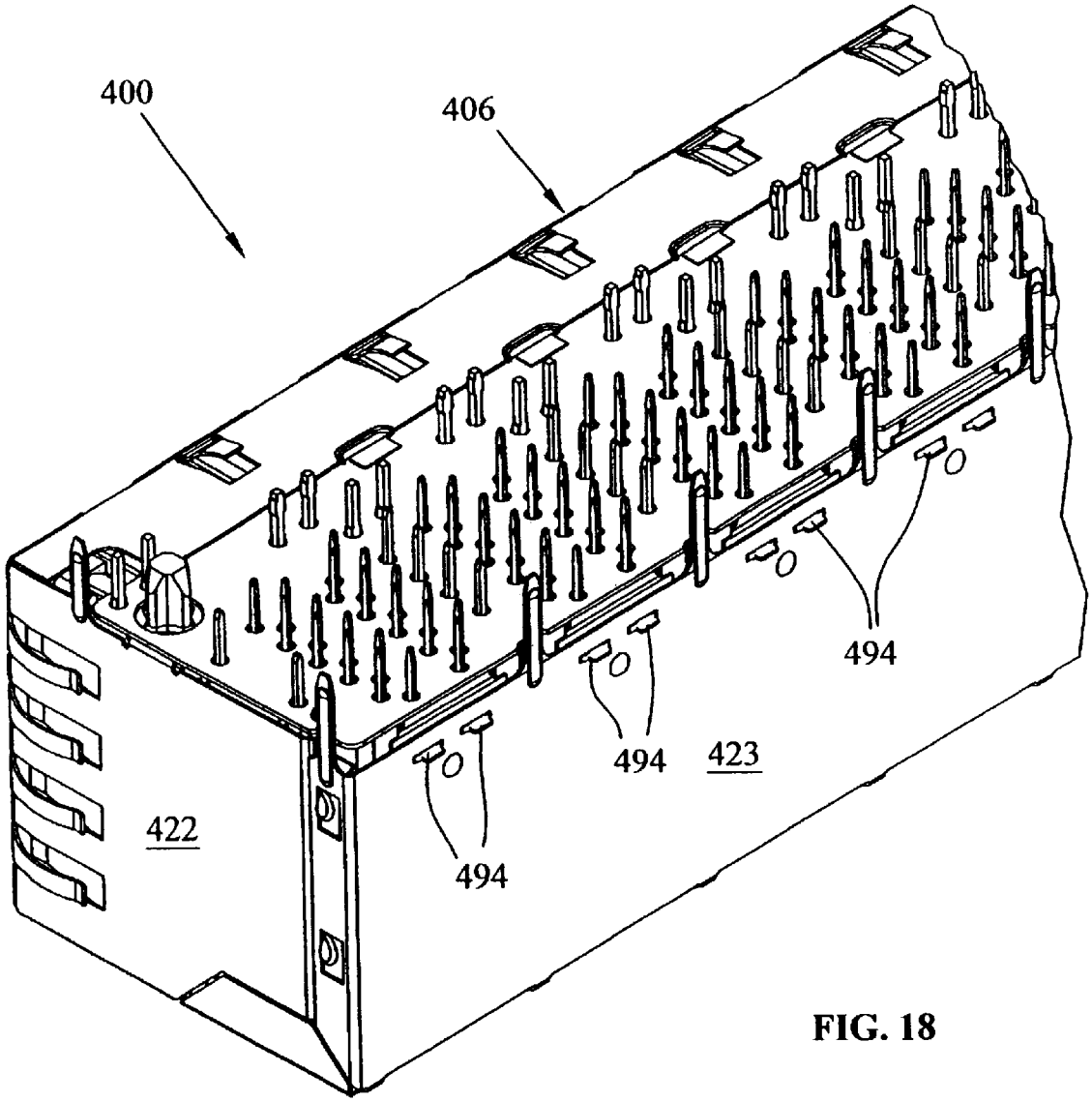
FIG. 18 shows an alternate embodiment of the shielding configuration.

An alternate embodiment of the shielding configuration is shown in FIG. 18, where an alternate connector 400 is shown having a shield 406. The connector 400 is identical to that described above, with the exception to the following change. The rear wall 423 includes apertures 434 for receiving tabs 494 therethrough. The tabs are defined so as to contact the shield wall at the location of the slots 434 for grounding purposes. The tabs 300 (FIG. 2) are not included, as the two shields are commoned through their connection, as shown in FIG. 13.

As such, the design disclosed herein provides multiple advantages. Firstly, as the LED modules are positioned intermediate upper and lower rows of cavities for the multi-port or stacked jack connector, the LEDs are easily configurable for both the top and bottom rows of the stacked jack assembly, such that the condition of the connectors can be monitored for multiple levels of ports.

Also, as the terminal subassembly is configured in a laminated configuration with the upper terminal assembly 134 and lower terminal assembly 138 being positioned between the center shield 136, and with the subassembly being configured in a somewhat Z-shaped configuration, this allows for the area between the lower housing portion 218 and housing portion 140 to be used for signal conditioning. That is, this allows for the area between housing portions 218 and 140 to receive the magnetic components on boards 142, 144.

Finally, given the shielding configuration, a center shield 148 can be positioned between signal conditioning components, a lower shield 146 can shield the lower side of the housings and signal conditioning components and a shield portion 194 can be positioned intermediate the two modular jack portions of terminals, all of which are decoupled and commoned to the outer shield member 6.

What is claimed is:

1. An electrical connector assembly having a plurality of rows of jacks for mating with a plurality of electrical plugs, the connector assembly comprising:

plural lead frames, said lead frames including front mating contact sections, and conductor contacting sections;

a center shield positioned between said lead frames;

a transverse shield positioned transversely to said center shield;

a lower shield positioned below said transverse shield, wherein said center shield, transverse shield and lower shield are commoned together;

a first array of passive components positioned on one side of said transverse shield, between said center shield and said lower shield;

a second array of passive components positioned on the opposite side of said transverse shield as said first array, between said center shield and said lower shield;

an insulating module housing at least partially surrounding said pluggable contact module, said center shield, said transverse shield, said lower shield, and said first and second array of passive components, thereby defining a pluggable contact module;

an insulating outer housing having a mating face having at least two connector receiving openings for receiving mating connectors therein, and module receiving openings for receipt of said pluggable contact modules.

2. The electrical connector assembly of claim 1, wherein at least one of said shields comprises a shielding contact extension, and said insulating module housing comprises an opening with said shielding contact extension, extending therethrough.

3. The electrical connector assembly of claim 2, further comprising an outer shielding member, substantially surrounding said insulating outer housing and said pluggable contact modules.

4. The electrical connector assembly of claim 3, wherein said outer shielding member includes an opening therethrough for receiving said shielding contact extension in an electrically engaging manner.

5. The electrical connector assembly of claim 4, wherein said lead frames include intermediate sections and printed circuit board contact sections, the, lead frames being profiled in a substantial Z-shape with the front mating contact sections of said plural lead frames being positioned adjacent to a central plane, with said printed circuit board contact sections from said plural lead frames being positioned proximate each other but remotely from said central plane, thereby defining a volume for said passive components, the pluggable contact module further comprising at least one printed circuit board carrying said passive components thereon, said printed circuit board being attached to said printed circuit board contact sections, with said passive components occupying said volume.

6. The assembly of claim 5, wherein said pluggable contact module is comprised of two lead frames.

7. The assembly of claim 6, wherein said lead frame intermediate contact sections include forward sections lying in a substantially horizontal plane, with said front mating contact sections being reversely bent from said forward sections.

8. The assembly of claim 7, wherein said lead frame intermediate contact sections further comprise perpendicular sections extending from said forward sections.

9. The assembly of claim 8, wherein said lead frame intermediate contact sections further comprise rearward sections extending from said perpendicular sections, said rearward sections lying in a substantially horizontal plane.

10. The assembly of claim 9, wherein said intermediate contact sections are at least partially overmolded with insulative material.

11. The assembly of claim 10, wherein said lead frames and said intermediate center shield are closely conforming to each other to form a lamination.

12. The assembly of claim 11, wherein said rearward sections are each overmolded with an insulative material, to define a side board mounting edge, with said printed circuit contacts extending therefrom.

13. The assembly of claim 12, wherein the printed circuit board contacts for each lead frame extend from opposite side edges.

14. The assembly of claim 13, further comprising two printed circuit boards mounted to said side board mounting edges.

15. The assembly of claim 14, wherein said lower shield, transverse center shield and said intermediate shield are all electrically commoned together.

16. The assembly of claim 15, further comprising an insulative housing shell positioned around printed circuit board and shields.

17. The assembly of claim 16, wherein said insulating housing has a top wall, a bottom wall, an intermediate wall forming an upper and lower row, and a plurality of modular openings formed in said upper and lower row, and said insulative shells are pluggable in said modular openings to form a stacked jack assembly.

18. An electrical connector assembly having a plurality of rows of jacks for mating with a plurality of electrical plugs, the connector assembly comprising:

plural lead frames, the lead frames including front mating contact sections, and conductor contacting sections;

a center shield positioned between said lead frames;

a transverse shield positioned transversely to said center shield;

first and second arrays of passive components positioned on opposite sides of said transverse shield;

an insulating module housing at least partially surrounding said pluggable contact module, said center shield, said transverse shield, said lower shield, and said first and second array of passive components, thereby defining a plurality of pluggable contact modules;

an insulating outer housing having a mating face having at least two connector receiving openings for receiving mating connectors therein, and module receiving openings for receipt of said pluggable contact modules; and an outer shielding member, substantially surrounding said insulating outer housing and said pluggable contact modules.

19. The electrical connector assembly of claim 18, further comprising a lower shield positioned below said transverse shield, wherein said center shield, transverse shield and lower shield are commoned together.

20. The electrical connector assembly of claim 19, wherein at least one of said shields comprises a shielding contact extension, and said insulating module housing comprises an opening with said shielding contact extension, extending therethrough.

21. The electrical connector assembly of claim 20, wherein said outer shielding member includes an opening therethrough for receiving said shielding contact extension in an electrically engaging manner.

22. The assembly of claim 21, wherein said lead frames and center shield member are Z-shaped in configuration.

23. The assembly of claim 22, wherein said lead frame intermediate contact sections include forward sections lying in a substantially horizontal plane, with said front mating contact sections being reversely bent from said forward sections.

24. The assembly of claim 23, wherein said lead frame intermediate contact sections further comprise perpendicular sections extending from said forward sections.

25. The assembly of claim 24, wherein said lead frame intermediate contact sections further comprise rearward sections extending from said perpendicular sections, said rearward sections lying in a substantially horizontal plane.

26. The assembly of claim 25, wherein said intermediate contact sections are at least partially overmolded with insulative material.

27. The assembly of claim 26, wherein said lead frames and said intermediate center shield are closely conforming to each other to form a lamination.

28. The assembly of claim 27, wherein said rearward sections are each overmolded with an insulative material, to define a side board mounting edge, with said printed circuit contacts extending therefrom.

29. The assembly of claim 28, wherein the printed circuit board contacts for each lead frame extend from opposite side edges.

30. The assembly of claim 29, further comprising two printed circuit boards mounted to said side board mounting edges.

31. The assembly of claim 30, wherein said lower shield, transverse center shield and said intermediate shield are all electrically commoned together.

32. The assembly of claim 31, further comprising an insulative housing shell positioned around printed circuit board and shields.

33. The assembly of claim 32, wherein said insulating housing has a top wall, a bottom wall, an intermediate wall forming an upper and lower row, and a plurality of modular opening formed in said upper and lower row, and said insulative shells are pluggable in said modular openings to form a stacked jack assembly.

* * * * *